US005634812A

United States Patent [19]

Chen

[11] Patent Number: 5,634,812

[45] Date of Patent: Jun. 3, 1997

[54] SAFETY LAMP SOCKET

[76] Inventor: Ming-Hsiung Chen, No. 16, Alley 3, Lane 227, Nung-An Street, Taipei, Taiwan

[21] Appl. No.: 505,696

[22] Filed: Jul. 21, 1995

[51] Int. Cl.[6] ..... H01R 4/24

[52] U.S. Cl. ..... 439/419; 439/665; 439/505

[58] Field of Search ..... 439/395, 404, 439/417, 418, 419, 665, 619, 699, 502, 505, 506, 575

[56] References Cited

U.S. PATENT DOCUMENTS

| | | | |
|---|---|---|---|
| 2,636,069 | 4/1953 | Gillert | 439/419 |
| 3,151,926 | 10/1964 | Schick et al. | 439/419 |
| 5,339,232 | 8/1994 | Lin | 439/419 |
| 5,389,008 | 2/1995 | Cheng et al. | 439/419 |

*Primary Examiner*—David L. Pirlot

*Attorney, Agent, or Firm*—Ladas & Parry

[57] ABSTRACT

A safety lamp socket including a socket body to hold a lamp bulb, a socket cap fastened to the socket body to hold down en electrical wire, and two metal contact plates mounted in a respective hole on the socket body to make electrical contact with a respective conductor in the electrical wire, wherein two metal spring plates are respectively mounted in a respective hole on the socket body and suspended below the metal contact plates, which metal spring plates are respectively forced by the tip contact and ring contact of the lamp bulb into contact with the metal contact plates when the lamp bulb is installed; the socket cap has two threaded downward plugs retained to two projecting blocks inside the socket boy for engaging the ring contact of the lamp bulb upon the installation of the lamp bulb, and a curved clamping plate for fastening to a support, the curved clamping plate having a keyhole-like slot for hanging on a wall nail, threaded portions and clamping portions for fastening the lamp socket to tree twigs, a tree branch, or the eaves, etc.

1 Claim, 8 Drawing Sheets

SAFETY LAMP SOCKET

BACKGROUND OF THE INVENTION

The present invention relates to lamp socket, and relates more particularly to a safety lamp socket which has two metal spring plates spaced below the center metal contact plate and the side metal contact plate to prevent an electric shock, and a curved clamping plate for fastening the lamp socket to any of a variety of supports such as tree twigs, tree branches, wall nails, flat supporting boards, the eaves, thw gutters, etc.

Regular lamp sockets for Christmas tree light set are generally comprised of a socket body having a center metal contact plate and a side metal contact plate, a socket cap fastened to the socket body to hold down the electrical wire against the center metal contact plate and the side metal contact plate. When the socket cap is fastened to the socket body, the pointed tips of the center metal contact plate and the side metal contact plate are forced to pierce the insulator of the electrical wire and to make electrical contact with a respective conductor in the electric wire. This structure of lamp socket is not safe in use. When a child inserts the fingers or a metal object into the socket body, an electric shock tends to occur. Furthermore, regular lamp sockets for Christmas tree light set also have a clip on the outside, which may be directly molded on the socket cap (see FIGS. 15, 16, and 17) or the socket body (see FIG. 18), for fastening to a support. The clip of a regular lamp socket can only fasten the socket body to small tree twigs or a suspension rope, and is not practical for fastening the socket body to a thick flat plate or the eaves, etc.

SUMMARY OF THE INVENTION

The present invention has been accomplished to provide a safety lamp socket which eliminates the aforesaid drawbacks.

According to one aspect of the present invention, the safety lamp socket comprises a socket body to hold a lamp bulb, a socket cap fastened to the socket body to hold down en electrical wire, a center metal contact plate and a side metal contact plate mounted in a respective hole on the socket body to make electrical contact with a respective conductor in the electrical wire, a center metal spring plate and a side metal spring plate mounted in a respective hole on the socket body. The center metal spring plate has a springy tail transversely suspended below the center metal contact plate. The side metal spring plate has a projecting strip obliquely suspended inside the socket body at one side adjacent to the side metal contact plate. When the lamp bulb is threaded into the socket body, the spring tail of the center metal spring plate and the projecting strip of the side metal spring plate are respectively forced by the tip contact and ring contact of the lamp bulb into contact with the center metal contact plate and the side metal contact plate.

According to another aspect of the present invention, the socket cap has a curved clamping plate for fastening to a support. The curved clamping plate has a keyhole-like slot for hanging on a wall nail, threaded portions and clamping portions for fastening the lamp socket to tree twigs, a tree branch, or the eaves, etc.

According to still another aspect of the present invention, the design of the present invention can be employed in any of a variety of lamp sockets which have an internally threaded plastic socket body.

DETAILED DESCRIPTION OF THE PREFERRED EMBODIMENT

Figure 1:
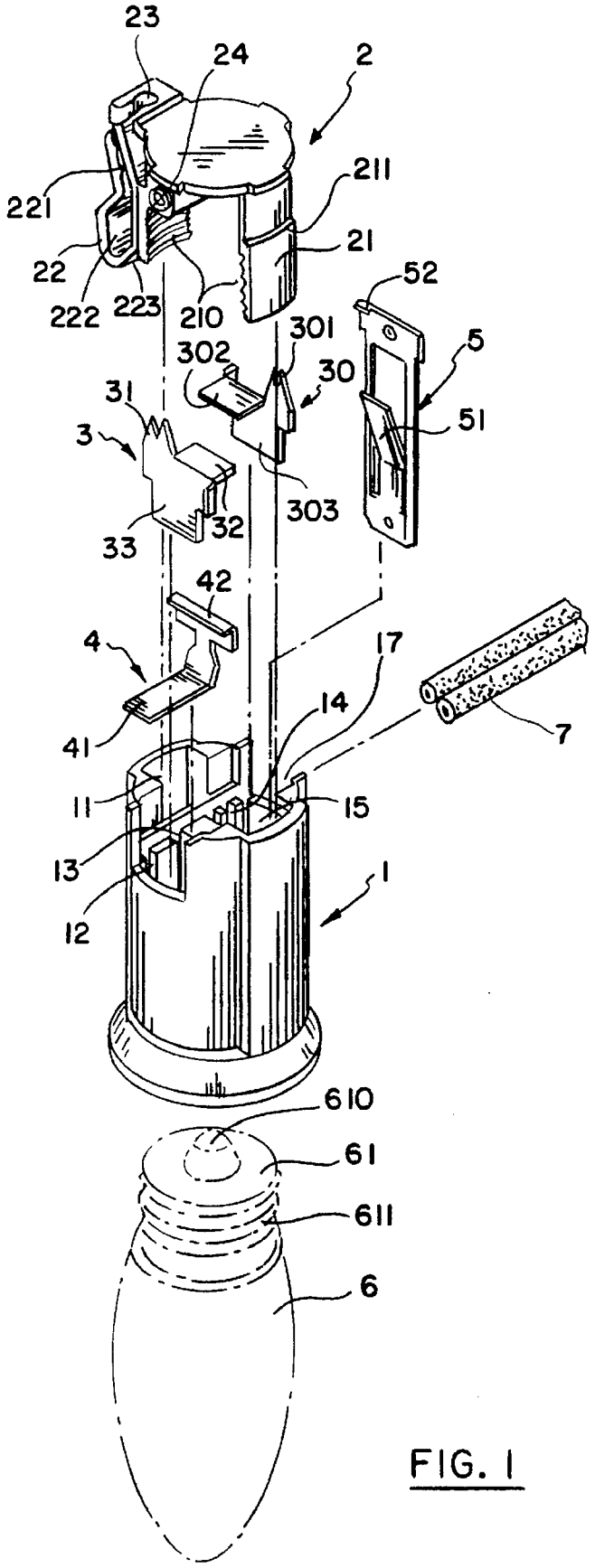
FIG. 1 is an exploded view of a safety lamp socket according to the present invention.
Figure 2:
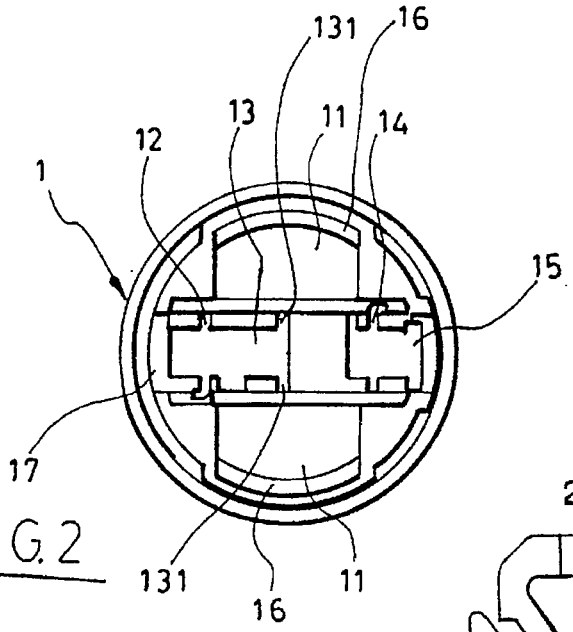
FIG. 2 is a top plain view of the socket body shown in FIG. 1.
Figure 3:
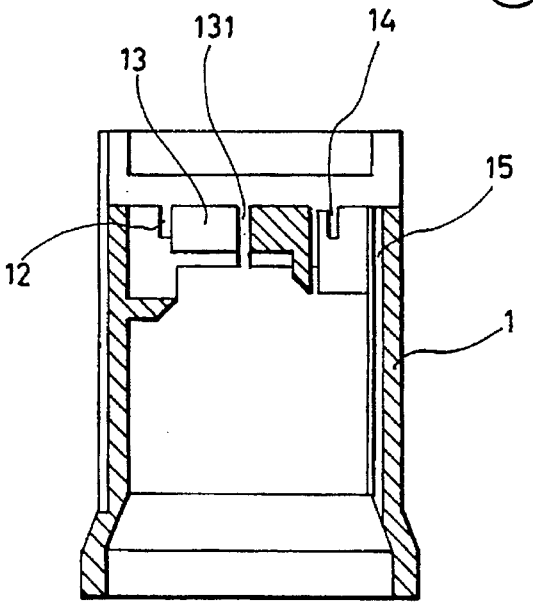
FIG. 3 is a longitudinal view in section of the socket body shown in FIG. 1.

Referring to FIGS. 1, 2, and 3, the socket body, referenced by 1, comprises a transverse wire groove 17 at the top side for mounting an electrical wire 7, two plug holes 11 at two opposite sides by the transverse wire groove 17, two inside projecting blocks 16 raised from the inside wall and respectively disposed below the plug holes 11, a first middle through hole 12 and a second middle through hole 13 spaced in the middle of the transverse wire groove 17 near one end, a third middle through hole 14 and a fourth middle through hole 15 bilaterally spaced in the middle of the transverse wire groove 17 near an opposite end. A center metal spring plate 4 is inserted into the second middle through hole 13, having a flanged transverse head 42 at one end fastened to a retaining groove 131 inside the second middle through hole 13 and a springy tail 41 at an opposite end disposed inside the socket body 1. A center metal contact plate 3 is inserted into the first middle through hole 12, having a pointed upright tip 31 at the top protruding over the transverse wire groove 17 for piercing the insulator of the electrical wire 7 to make electrical contact with one conductor of the electrical wire 7, a downward plug portion 33 at the bottom inserted into the first middle through hole 12 and suspended inside the socket body 1 above the springy tail 41, and a horizontal stop portion 32 stopped above the first middle through hole 12. A side metal spring plate 5 is inserted into the fourth middle through hole 15, having an angled stop portion 52 at the top stopped above the fourth middle through hole 15 and a projecting strip 51 obliquely upwardly raised from one side and suspending inside the socket body 1. A side metal contact plate 30 is inserted into the third middle through hole 14, having a pointed upright tip 301 at the top protruding over the transverse wire groove 17 for piercing the insulator of the electrical wire 7 to make electrical contact with one conductor of the electrical wire 7, a downward plug portion 303 at the bottom inserted into the third middle through hole 14 and facing the projecting strip 51 of the side metal spring plate 5, and a horizontal stop portion 302 stopped above the third middle through hole 14. The socket cap 2 is fastened to the socket body 1 to hold down the electrical wire 7, thereby rendering the pointed upright tips 31 and 301 of the center metal contact plate 3 and the side metal contact plate 30 to pierce the insulator of the electrical wire 7 and to make electrical contact with a respective conductor of the electrical wire 7. As illustrated, the socket cap 2 comprises a bottom pressure block 24 in the middle for holding down the electrical wire 7, two downward plugs 21 at two opposite sides for mounting in the plug holes 11 of the socket body 1, and a curved clamping plate 22 raised from the periphery, wherein each downward plug 21 has a step 211 at an outer side for engaging one projecting block 16 of the socket body 1, and a threaded portion 210 at an inner side for engaging the ring contact 611 of the base 61 of a lamp bulb 6; the curved clamping plate 22 has a plurality of threaded portions 221, which face the periphery of the socket body 1 when the socket cap 2 is installed, and a keyhole-like slot 23.

Figure 4:
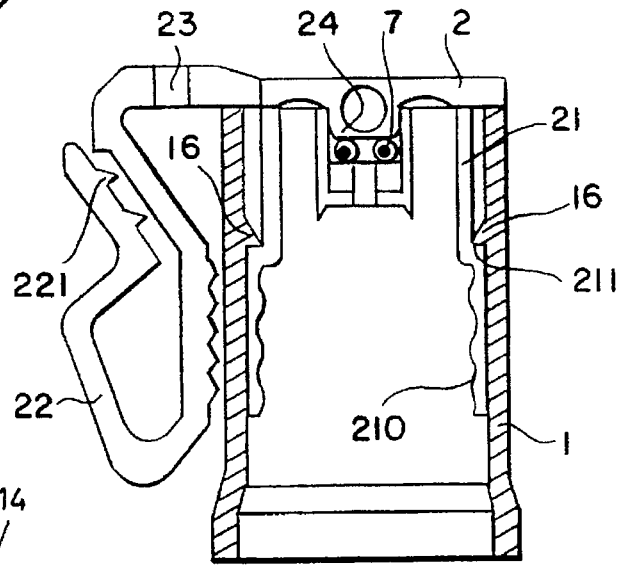
FIG. 4 is a longitudinal view in section of the assembly of the socket body and the socket cap shown in FIG. 1.
Figure 6:
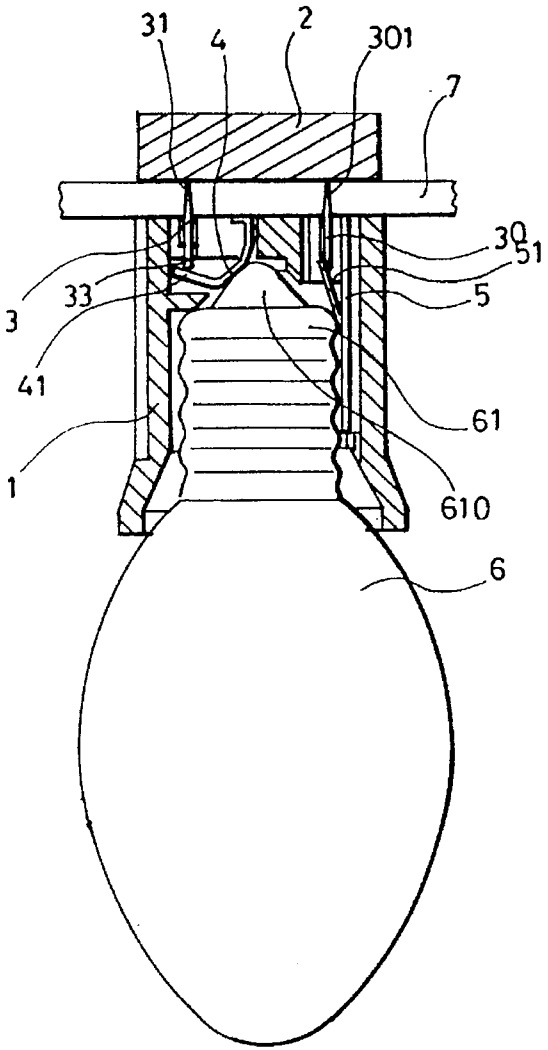
FIG. 6 is similar to FIG. 5 but showing the lamp bulb installed.
Figure 5:
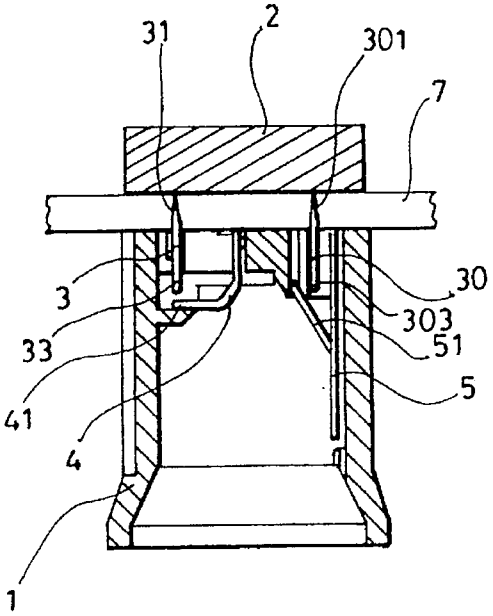
FIG. 5 is an assembly view in section of FIG. 1 before the installation of the lamp bulb.

Referring to FIGS. 4, 5, and 6, when the electrical wire 7 is mounted in the wire groove 17, the socket cap 2 is fastened to the socket body 1 to hold down the electrical wire 7 by inserting the downward plugs 21 into the plug holes 11 for permitting the steps 211 of the downward plugs 21 to be respectively engaged with the projecting blocks 16 at the bottom. When the socket cap 2 is installed, the electrical wire 7 is forced by the pressure block 24 against the pointed upright tips 31 and 301, thereby rendering the pointed upright tips 31 and 301 to pierce the insulator of the electrical wire 7 and to make electrical contact with a respective conductor of the electrical wire 7. When the base 61 of the lamp bulb 6 is threaded into the socket body 1, the ring contact 611 of the base 61 is also threaded into engagement with the threaded portions 210 of the downward plugs 21 of the socket cap 2, the springy tail 41 of the center metal spring plate 4 is forced upward by the tip contact 610 of the base 61 into contact with the downward plug portion 33 of the center metal contact plate 3, and the projecting strip 51 of the side metal spring plate 5 is forced backward by the ring contact 611 of the base 61 into contact with the downward plug portion 303 of the side metal contact plate 30, and therefore the lamp bulb 6 is electrically connected to the electrical wire 7. When the lamp bulb 6 is removed from the socket body 1, the springy tail 41 of the center metal spring plate 4 and the projecting strip 51 of the side metal spring plate 5 automatically move away from the downward plug portions 33 and 303 and return to their former shapes.

Figure 7:
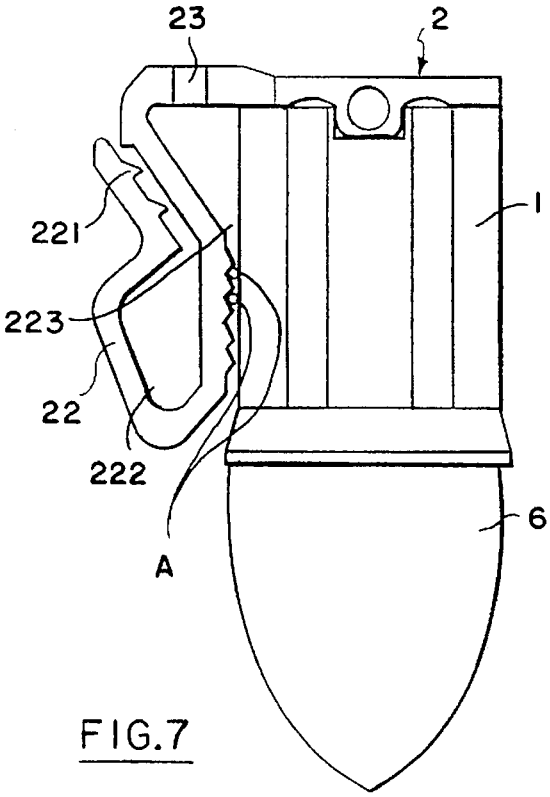
FIG. 7 is an applied view of the present invention, showing the lamp socket fastened to tree twigs by the clamping plate thereof.
Figure 8:
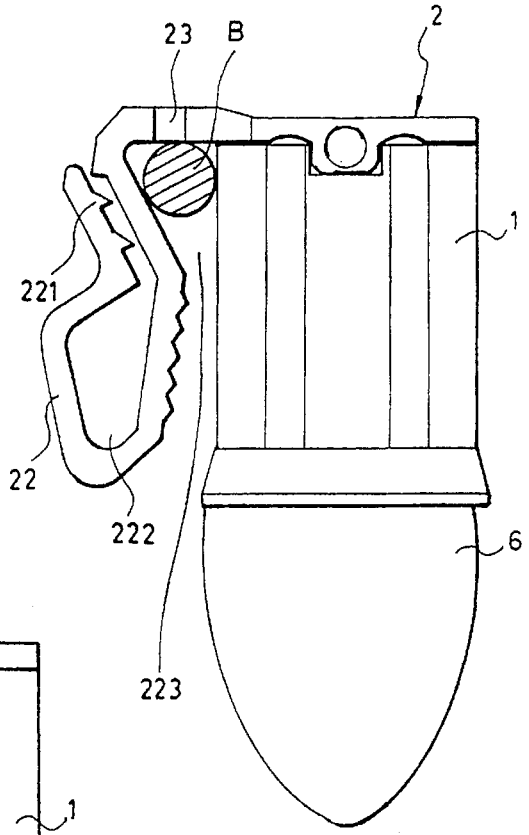
FIG. 8 is another applied view of the present invention, showing the lamp socket fastened to a relative bigger tree branch by the clamping plate thereof.
Figure 9:
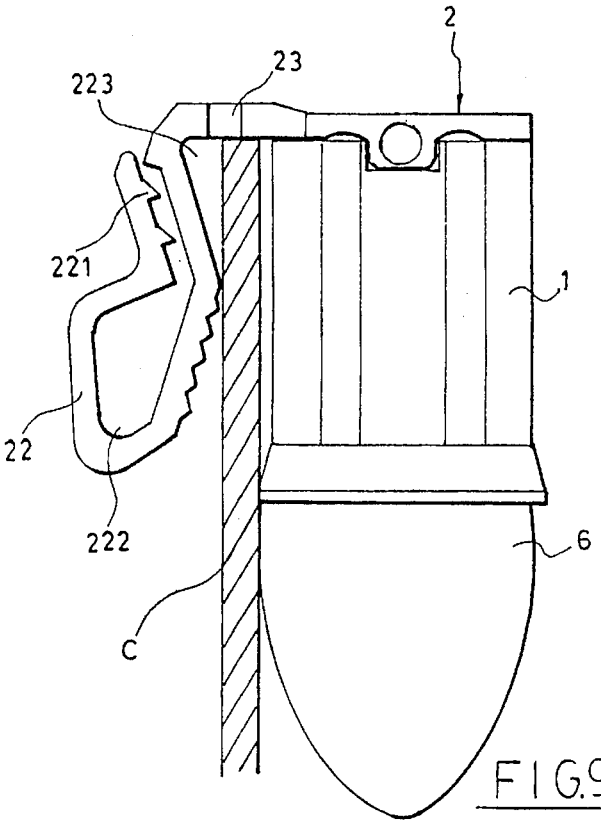
FIG. 9 is still another applied view of the present invention, showing the lamp socket fastened to a flat board by the clamping plate thereof.
Figure 10:
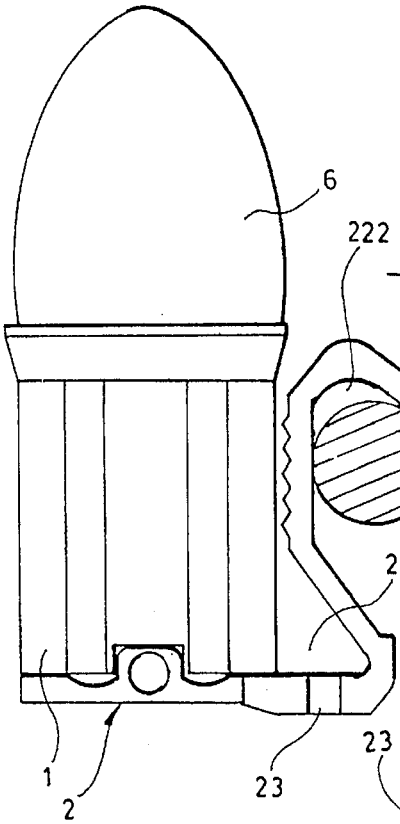
FIG. 10 is still another applied view of the present invention, showing the lamp socket fastened to a big tree branch by the clamping plate thereof.
Figure 11:
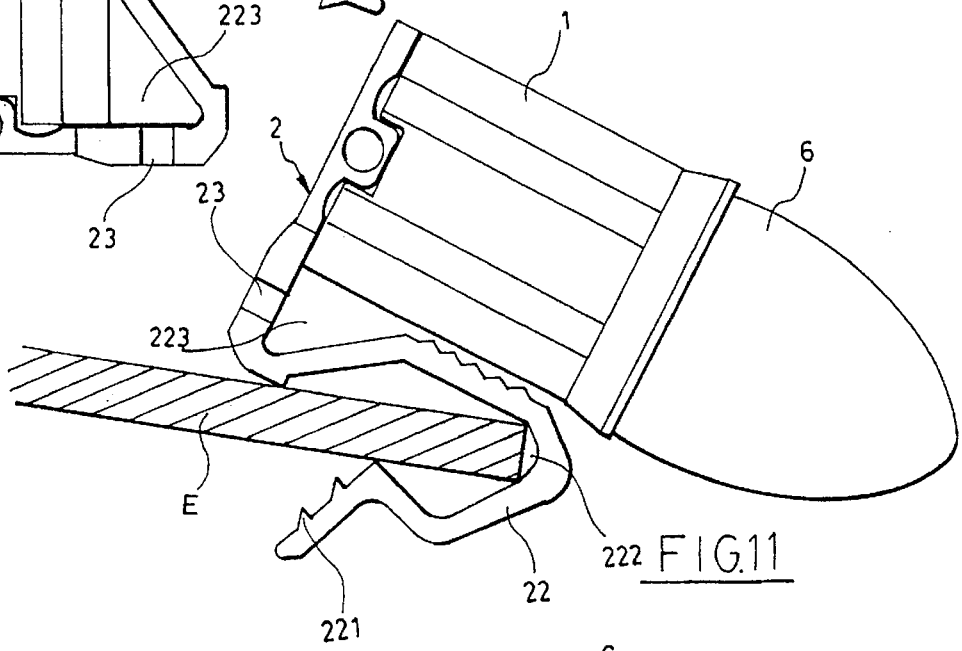
FIG. 11 is still another applied view of the present invention, showing the lamp socket fastened to the eaves by the clamping plate thereof.
Figure 12:
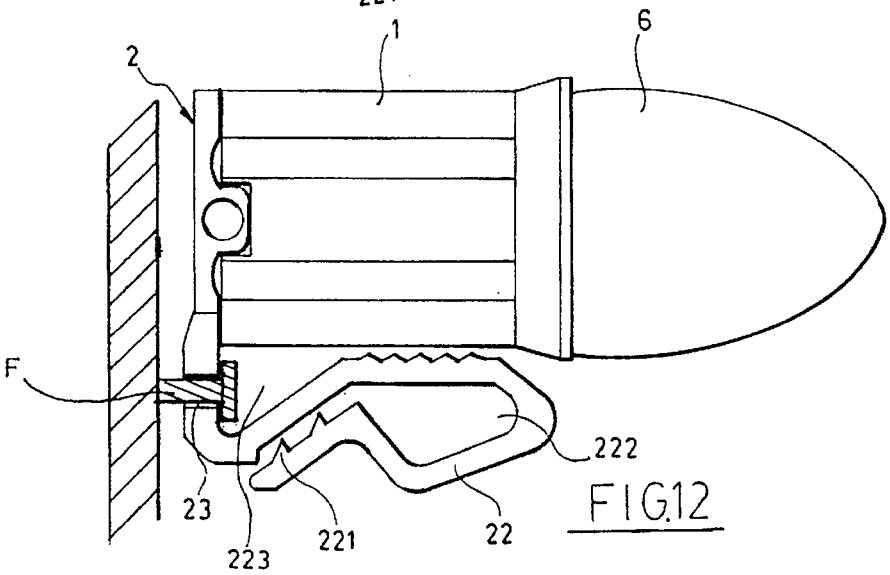
FIG. 12 is still another applied view of the present invention, showing the lamp socket fastened to a nail on the wall by the clamping plate thereof.
Figure 13:
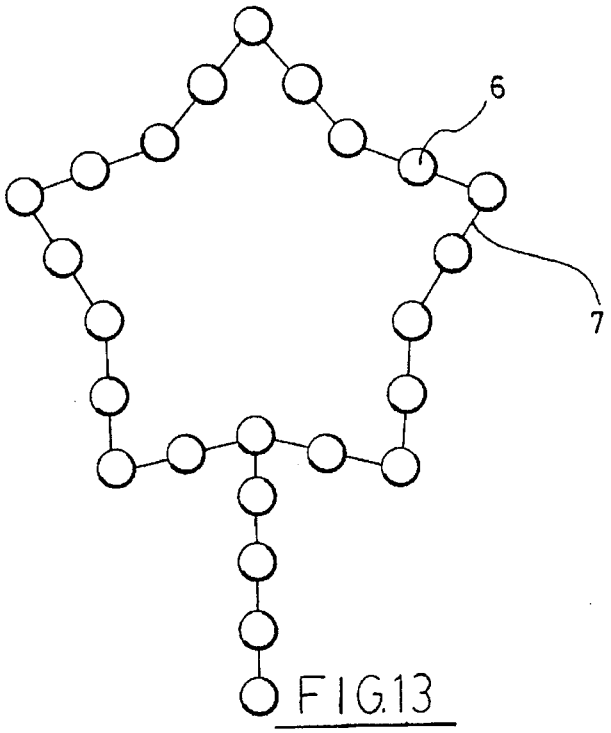
FIG. 13 is still another applied view of the present invention, showing the lamp sockets of a decorative string fastened to a series of nails on the wall and arranged in the form of a pentagram.

Referring to FIGS. 7 to 13, through the curved clamping plate 22, the lamp socket can be installed in any of a variety of support means. As illustrated in FIGS. 1 and 7, the curved clamping plate 22 further comprises a first clamping portion 223 on the outside, which is defined within the curved clamping plate 22 and the socket body 1, and a second clamping portion 222 on the inside, which is defined by the curved clamping plate 22 itself. By means of the first clamping portion 223, the lamp socket can be fastened to tree twigs A. As illustrated in FIG. 7, tree twigs A are fastened between the curved clamping plate 22 and the socket body 1 at the bottom narrow area of the first clamping portion 223. By means of the first clamping portion 223, the lamp socket can be fastened to a bigger tree branch B (see FIG. 8) or a flat board C (see FIG. 9). By means of the second clamping portion 222, the lamp socket can be fastened to a more big tree branch D (see FIG. 10) or the eaves E (see FIG. 11). By means of the keyhole-like slot 23, the lamp socket can be fastened to a nail F on the wall (see FIG. 12). Therefore, a decorative string can be hung on nails on the wall and arranged in any of a variety of the desired patterns, for example, a pentagram (see FIG. 13).

Figure 14:
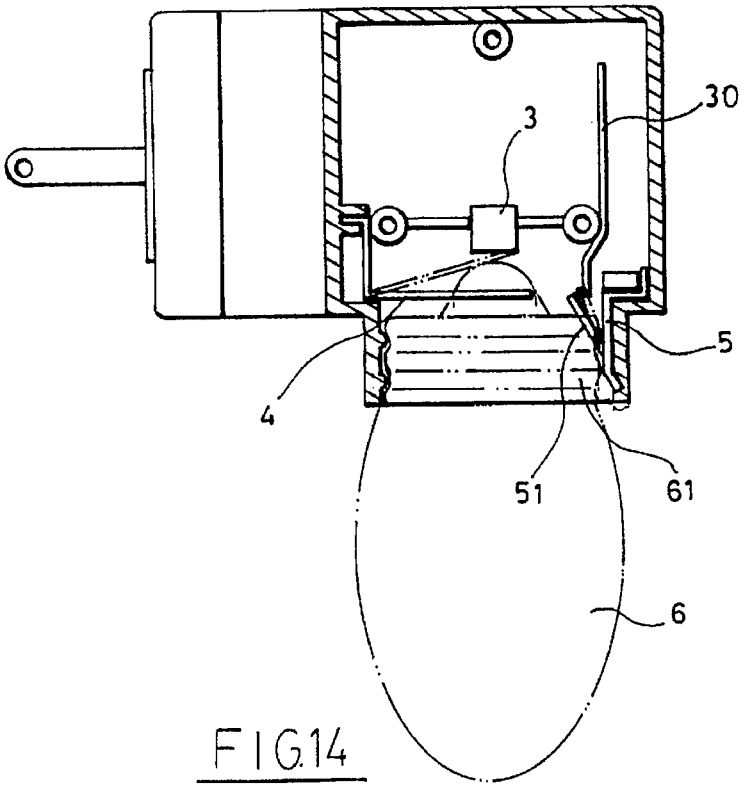
FIG. 14 shows a wall lamp according to the present invention.
Figure 15:
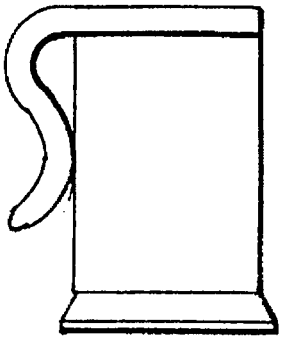
FIG. 15 shows a lamp socket with a clip according to the prior art.
Figure 16:
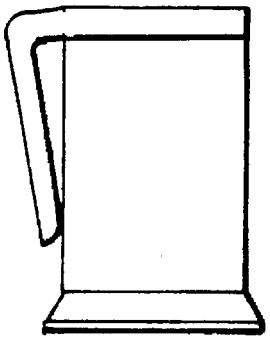
FIG. 16 shows another structure of lamp socket with a clip according to the prior art.
Figure 17:
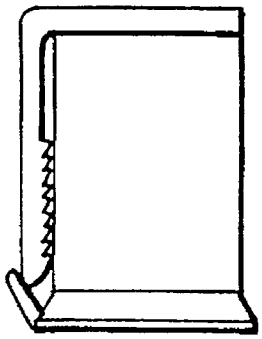
FIG. 17 shows still another structure of lamp socket with a clip according to the prior art.
Figure 18:
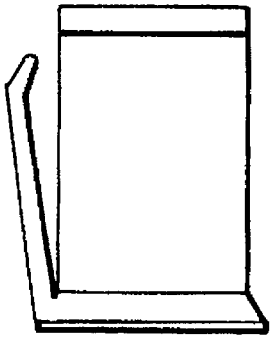
FIG. 18 shows still another structure of lamp socket according to the prior art.

The present invention can be employed in other types of lamps, for example, a wall lamp as shown in FIG. 14. As illustrated in FIG. 14, the projecting strip 51 of the side metal spring plate 5 obliquely projecting upwards inside the socket body of the wall-mount lamp socket and spaced below the side metal contact plate 30, which projecting strip 51 is forced into contact with the side metal contact plate 30 when the base 61 of the lamp bulb 6 is threaded into the socket body, and the center metal spring plate 4 is suspended inside the socket body spaced below the center contact metal plate 3, which center metal spring plate 4 is forced into contact with the center contact metal plate when the base 61 of the lamp bulb 6 is threaded into the socket body. When the lamp bulb 6 is removed from the lamp socket, the center metal spring plate 4 and the projecting strip 51 of the side metal spring plate 5 automatically return to their former shapes, and disconnect from the center contact metal plate 3 and the side metal contact plate 30.

Figure 19:
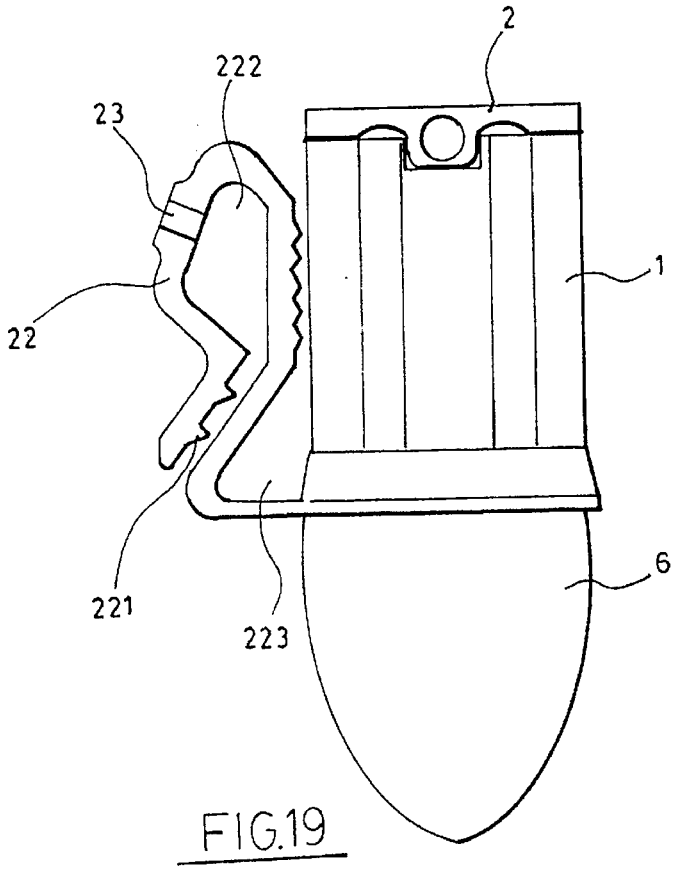
FIG. 19 shows the clamping plate molded on the bottom end of the socket body according to the present invention.
Figure 20:
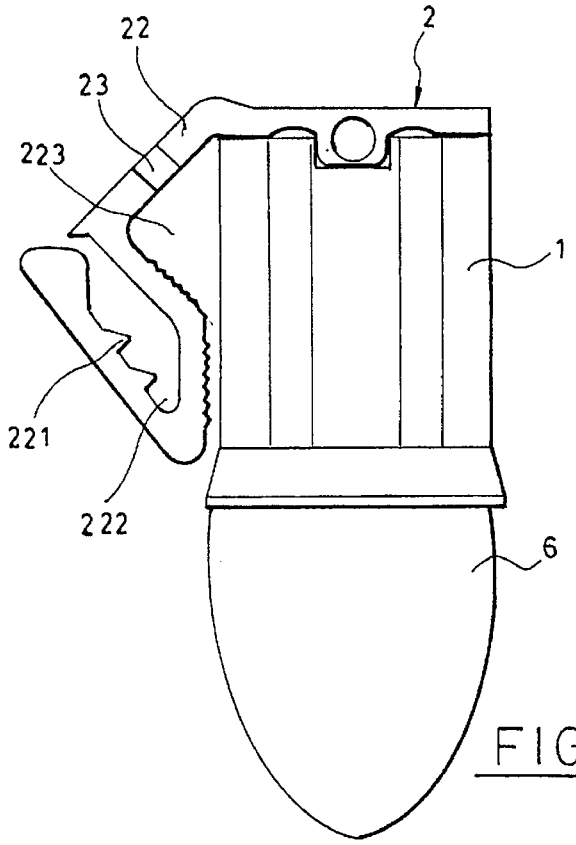
FIG. 20 shows the clamping plate molded on the socket cap according to the present invention.

It is to be understood that the drawings are designed for purposes of illustration only, and are not intended as a definition of the limits and scope of the invention disclosed. For example, the curved clamping plate 22 can be molded on the socket body 1 as shown in FIG. 19, or on the socket cap 2 as shown in FIG. 20.

I claim:

1. A safety lamp socket comprising:

a socket body having a transverse wire groove for mounting an electrical wire, two plug holes at two opposite sides by said transverse wire groove, two inside projecting blocks respectively disposed below said plug holes, a first middle through hole and a second middle through hole spaced in the middle of said transverse wire groove near one end, a third middle through hole and a fourth middle through hole bilaterally spaced in the middle of said transverse wire groove near an opposite end, said second middle through hole comprising a retaining groove on the inside;

an electric wire mounted in said transverse wire groove;

a socket cap fastened to said socket body to hold down said electrical wire, having a bottom pressure block pressed against said electrical wire, two downward plugs at two opposite sides respectively inserted into the plug holes of said socket body, and a curved clamping plate raised from the periphery, each downward plug having a step at an outer side engaged with one projecting block of said socket body and a threaded portion at an inner side for engaging a ring contact of a base of a lamp bulb, said curved clamping plate comprising a plurality of threaded portions, which face the periphery of said socket body, a keyhole-like slot for hanging on a wall nail, a second clamping portion defined on an inside thereof for fastening to a larger support surface, and a first clamping portion defined on an outside surface between said curved clamping plate and said socket body for fastening to tree twigs, a bigger tree branch, or a flat board;

a center metal spring plate inserted into said second middle through hole, having a flanged transverse head at one end fastened to the retaining groove inside said second middle through hole and a springy tail at an opposite end disposed inside said socket body;

a center metal contact plate inserted into said first middle through hole, having a pointed upright tip protruding over said transverse wire groove and piercing the insulator of said electrical wire to make electrical contact with one conductor thereof, a downward plug portion inserted into said first middle through hole and suspended over the springy tail of said center metal spring plate, and a horizontal stop portion stopped outside said first middle through hole; a side metal spring plate inserted into said fourth middle through hole, having an angled stop portion stopped outside said fourth middle through hole and a projecting strip obliquely upwardly raised from one side and suspending inside said socket body; and a side metal contact plate inserted into said third middle through hole, having a pointed upright tip protruding over said transverse wire groove and piercing the insulator of said electrical wire to make electrical contact with one conductor thereof, a downward plug portion inserted into said third middle through hole and facing the projecting strip of said side metal spring plate, and a horizontal stop portion stopped outside said third middle through hole;

wherein when a lamp bulb is threaded into said socket body, the springy tail of said center metal spring plate and the projecting strip of said side metal spring plate are respectively forced by a tip contact and ring contact of the base of the lamp bulb into contact with the downward plug portions of said center metal contact plate sand said side metal contact plate; when the lamp bulb is removed from said socket body, the spring tail of said center metal spring plate and the projecting strip of said side metal spring plate automatically return to their former shapes and respectively disconnect from said center metal contact plate and said side metal contact plate.

* * * * *